US012465151B2

(12) United States Patent
Kong

(10) Patent No.: US 12,465,151 B2
(45) Date of Patent: Nov. 11, 2025

(54) ANGLE-ADJUSTABLE FOLDING BED

(71) Applicant: Jiaxing Rondure Intelligent Furniture Co., Ltd., Jiaxing (CN)

(72) Inventor: Jiacheng Kong, Jiaxing (CN)

(73) Assignee: Jiaxing Rondure Intelligent Furniture Co., Ltd., Jiaxing (CN)

( * ) Notice: Subject to any disclaimer, the term of this patent is extended or adjusted under 35 U.S.C. 154(b) by 204 days.

(21) Appl. No.: 18/469,806

(22) Filed: Sep. 19, 2023

(65) Prior Publication Data

US 2024/0389761 A1 Nov. 28, 2024

(30) Foreign Application Priority Data

May 25, 2023 (CN) ..... 202310604107.6

(51) Int. Cl.

| | |
|---|---|
| ***A47C 20/10*** | (2006.01) |
| ***A47C 19/12*** | (2006.01) |
| ***A47C 21/08*** | (2006.01) |

(52) U.S. Cl.

CPC ..... *A47C 20/10* (2013.01); *A47C 19/122* (2013.01); *A47C 21/08* (2013.01)

(58) Field of Classification Search

CPC ..... A47C 20/08; A47C 17/70; A47C 17/74; A47C 19/12; A47C 19/122; A47C 20/10

See application file for complete search history.

(56) References Cited

U.S. PATENT DOCUMENTS

| | | | | |
|---|---|---|---|---|
| 9,044,366 | B2 * | 6/2015 | Rawls-Meehan | A61G 7/018 |
| 10,694,860 | B2 * | 6/2020 | Jin | A47C 17/70 |
| 11,413,201 | B2 * | 8/2022 | Zeng | A47C 17/1756 |
| 2004/0148704 | A1 * | 8/2004 | Tekulve | A61G 7/015 5/618 |
| 2008/0276872 | A1 * | 11/2008 | Chern | A01K 1/0353 119/28.5 |
| 2019/0223609 | A1 * | 7/2019 | Sherman | A47C 27/14 |
| 2020/0187662 | A1 * | 6/2020 | Zeng | A47C 19/122 |
| 2020/0237105 | A1 * | 7/2020 | Eskridge, III | A47C 27/14 |
| 2020/0397147 | A1 * | 12/2020 | Ren | A47C 19/021 |
| 2022/0095802 | A1 * | 3/2022 | Chen | A47C 20/041 |
| 2022/0304476 | A1 * | 9/2022 | Liu | A47C 20/12 |
| 2022/0312980 | A1 * | 10/2022 | Shan | A47C 19/12 |
| 2022/0369822 | A1 * | 11/2022 | Ma | A47C 19/122 |
| 2023/0200546 | A1 * | 6/2023 | Shih | A47C 20/041 5/174 |
| 2023/0225518 | A1 * | 7/2023 | Huang | A47C 20/041 5/174 |
| 2024/0099472 | A1 * | 3/2024 | Deng | A47C 20/041 |
| 2024/0197076 | A1 * | 6/2024 | Chung | A47C 19/12 |
| 2024/0206628 | A1 * | 6/2024 | Xu | A47C 29/003 |

(Continued)

*Primary Examiner* — David E Sosnowski

(74) *Attorney, Agent, or Firm* — Westbridge IP LLC

(57) ABSTRACT

An angle-adjustable folding bed includes a bed bottom frame, the bed bottom frame includes a front lower frame and a rear lower frame, the rear end of the front lower frame is rotatably connected with the front end of the rear lower frame, and a back adjusting assembly disposed on the front lower frame and/or a leg adjusting assembly disposed on the rear lower frame are/is further included. The angle-adjustable folding bed of the present application has both folding function and angle adjusting function, and may be adjusted to a thinner thickness size during storage and transportation, thus greatly reducing the logistics cost.

13 Claims, 6 Drawing Sheets

(56) References Cited

U.S. PATENT DOCUMENTS

| | | | | |
|---|---|---|---|---|
| 2024/0206633 | A1* | 6/2024 | Shih | A47C 20/041 |
| 2024/0285084 | A1* | 8/2024 | Wang | A61G 7/018 |
| 2024/0293276 | A1* | 9/2024 | Shih | A61G 7/018 |

* cited by examiner

ANGLE-ADJUSTABLE FOLDING BED

CROSS-REFERENCE TO RELATED APPLICATIONS

This application claims priority to Chinese Patent Application No. 202310604107.6, filed on May 25, 2023, the content of which is incorporated herein by reference in its entirety.

TECHNICAL FIELD

The present application relates to the technical field of folding beds, in particular to an angle-adjustable folding bed.

BACKGROUND

A folding bed is a widely used bed body type, with a bed head and a bed tail rotatably connected. By folding the bed head and the bed tail in half, the overall size of the bed body along the length direction may be reduced for easy storage and transportation. However, in order to reduce the whole volume, the folding bed is generally simple in structure, the angles of the bed head and the bed tail cannot be flexibly adjusted, and thus the comfort is not sufficient. If bed head and bed tail angle adjustable mechanisms are added, the thickness size is large in the solution realized by the relevant art, and storage and transportation costs are increased.

SUMMARY

An objective of the present application is to provide an angle-adjustable folding bed which is convenient to store and transport while comfort is improved.

In order to realize the purpose, the technical solution of the present application is as follows.

An angle-adjustable folding bed includes a bed bottom frame, the bed bottom frame includes a front lower frame and a rear lower frame, the rear end of the front lower frame is rotatably connected with the front end of the rear lower frame, and a back adjusting assembly disposed on the front lower frame and/or a leg adjusting assembly disposed on the rear lower frame are/is further included.

The back adjusting assembly includes a first upper frame, a front driver, a front sliding frame and a connecting rod assembly; the rear end of the first upper frame is rotatably connected with the front lower frame; the front driver is mounted on the front lower frame and is connected with the front sliding frame; the front sliding frame is slidably mounted on the front lower frame, and the front driver drives the front sliding frame to linearly slide along the front-back direction of the front lower frame; the connecting rod assembly is rotatably connected with the first upper frame, the front sliding frame and the front lower frame, and the front sliding frame drives the first upper frame to incline forwards and lean backwards through the connecting rod assembly when sliding forwards and backwards.

The connecting rod assembly includes a first connecting rod, a second connecting rod, a third connecting rod, a fourth connecting rod and a fifth connecting rod; one end of the first connecting rod is rotatably connected with the front sliding frame, the middle of the first connecting rod is rotatably connected with one end of the second connecting rod, the other end of the second connecting rod is rotatably connected with one end of the third connecting rod, the other end of the third connecting rod is rotatably connected with one end of the fourth connecting rod, the other end of the fourth connecting rod is rotatably connected with the front lower frame, one end of the fifth connecting rod is slidably connected with the front lower frame, the other end of the fifth connecting rod is rotatably connected with the first upper frame, the middle of the fifth connecting rod is rotatably connected with the middle of the third connecting rod, a limiting piece is disposed on the first connecting rod, and a blocking part which is configured for limiting abutting with the limiting piece is disposed on the second connecting rod; in a process that the front sliding frame moves towards a direction close to the fourth connecting rod, the first connecting rod is driven to rotate to a state that the limiting piece is in contact with the blocking part, and rotation of the first connecting rod and the second connecting rod in an original rotating direction is blocked; in a process that the front sliding frame moves towards a direction further close to the fourth connecting rod, the fifth connecting rod drives the first upper frame to incline forwards under the action of the third connecting rod; in a process that the front sliding frame moves towards a direction away from the fourth connecting rod, the first connecting rod rotates counter-clockwise till the limiting piece is separated from the blocking part, and in a process that the front sliding frame moves towards a direction further away from the fourth connecting rod, the fifth connecting rod drives the first upper frame to lean backwards under the action of the third connecting rod.

The leg adjusting assembly includes a second upper frame, a third upper frame rotatably connected with the second upper frame, a pull rod, a rear driver, a rear sliding frame and a connecting rod assembly; the rear driver is mounted on the rear lower frame and connected with the rear sliding frame; the rear sliding frame is slidably mounted on the rear lower frame, and the rear driver drives the rear sliding frame to move linearly along the front-back direction of the rear lower frame; the connecting rod assembly is rotatably connected with the second upper frame, the rear sliding frame and the rear lower frame; the connecting rod assembly includes a first connecting rod, a second connecting rod, a third connecting rod, a fourth connecting rod and a fifth connecting rod; one end of the first connecting rod is rotatably connected with the rear sliding frame, the middle of the first connecting rod is rotatably connected with one end of the second connecting rod, the other end of the second connecting rod is rotatably connected with one end of the third connecting rod, the other end of the third connecting rod is rotatably connected with one end of the fourth connecting rod, the other end of the fourth connecting rod is rotatably connected with the front lower frame, one end of the fifth connecting rod is slidably connected with the rear lower frame, the other end of the fifth connecting rod is rotatably connected with the second upper frame, the middle of the fifth connecting rod is rotatably connected with the middle of the third connecting rod, a limiting piece is disposed on the first connecting rod, and a blocking part which is configured for limiting abutting with the limiting piece is disposed on the second connecting rod; the second upper frame is rotatably connected with the rear lower frame, two ends of the pull rod are rotatably connected with the third upper frame and the rear lower frame respectively, and the second upper frame, the third upper frame, the pull rod and the rear lower frame are rotatably connected to form a quadrangle; in a process that the rear sliding frame moves towards a direction close to the fourth connecting rod, the first connecting rod is driven to rotate to a state that the limiting piece is in contact with the blocking part, and rotation of the first connecting rod and the second connecting rod in an original rotating direction is blocked; in a process that the rear sliding frame moves towards a direction further close to the fourth connecting rod, the fifth connecting rod drives the second upper frame to incline forwards under the action of the third connecting rod, and the second upper frame drives the third upper frame which is lifted up under the action of the pull rod; in a process that the rear sliding frame moves towards a direction away from the fourth connecting rod, the first connecting rod rotates counterclockwise till the limiting piece is separated from the blocking part, and in a process that the rear sliding frame moves towards a direction further away from the fourth connecting rod, the fifth connecting rod drives the second upper frame to lie flat and the third upper frame to move downwards under the action of the third connecting rod.

The blocking part is a concave position into which the limiting piece may fall.

When the front sliding frame moves to a position furthest away from the fourth connecting rod, the height of the connecting rod assembly is smaller than or equal to that when the front lower frame and the first upper frame are overlapped.

When the rear sliding frame moves to a position furthest away from the fourth connecting rod, the height of the connecting rod assembly is smaller than or equal to that when the rear lower frame and the second upper frame are overlapped.

A first roller is mounted at the other end of the first connecting rod.

A guardrail is further included, which is separately inserted on the third upper frame.

The lower surfaces of the front lower frame and the rear lower frame are both configured for direct contact with the ground; when the bed bottom frame, the back adjusting assembly and the leg adjusting assembly are folded, the thickness of the angle-adjustable folding bed is not greater than 110 mm; when the bed bottom frame is unfolded, the back adjusting assembly is folded, and the leg adjusting assembly is folded, the thickness of the angle-adjustable folding bed is not greater than 55 mm.

The front lower frame is rotatably connected with the rear lower frame through an intermediate piece; the intermediate piece is located on the side of the front lower frame and the rear lower frame, the rear end of the front lower frame is hinged with the front end of the intermediate piece, and the rear end of the intermediate piece is hinged with the front end of the rear lower frame; and the side of the first upper frame extends out of the side of the bed bottom frame to shield the intermediate piece in the vertical direction.

The front lower frame is rotatably connected with the rear lower frame through an intermediate piece; the rear end of the front lower frame is hinged with the front end of the intermediate piece, and the rear end of the intermediate piece is hinged with the front end of the rear lower frame; and the sides of the second upper frame and the third upper frame extend out of the side of the bed bottom frame to shield the intermediate piece in the vertical direction.

Each of the front lower frame and the rear lower frame includes a rectangular outer frame, two parallel channel steels are disposed in the outer frame, the length direction of the channel steel is parallel to the length direction of the angle-adjustable folding bed, and the notches of the two channel steels are disposed face to face; and the side, close to the channel steel, of the front sliding frame is respectively provided with two pulleys rotatably disposed, the pulleys are located in the channel steel, and the front driver is disposed horizontally.

The fourth connecting rod has the smallest distance between one end and the other end relative to the first connecting rod, the second connecting rod and the third connecting rod, the third connecting rod has the largest distance between one end and the other end relative to the first connecting rod and the second connecting rod, and the length after the first connecting rod and the second connecting rod are rotatably connected is greater than the distance between one end and the other end of the third connecting rod.

Compared with the relevant art, the present application obtains the following beneficial technical effects.

The angle-adjustable folding bed of the present application has both folding function and angle adjusting function, and may be adjusted to a thinner thickness size during storage and transportation, thus greatly reducing the logistics cost.

BRIEF DESCRIPTION OF THE DRAWINGS

In order to describe the technical solutions in the embodiments of the present application or the relevant art more clearly, the drawings required to be used in descriptions about the embodiments will be simply introduced below, obviously, the drawings described below are only some embodiments of the present application, and other drawings can further be obtained by those of ordinary skill in the art according to the drawings without creative work.

DETAILED DESCRIPTION OF THE EMBODIMENTS

Figure 1:
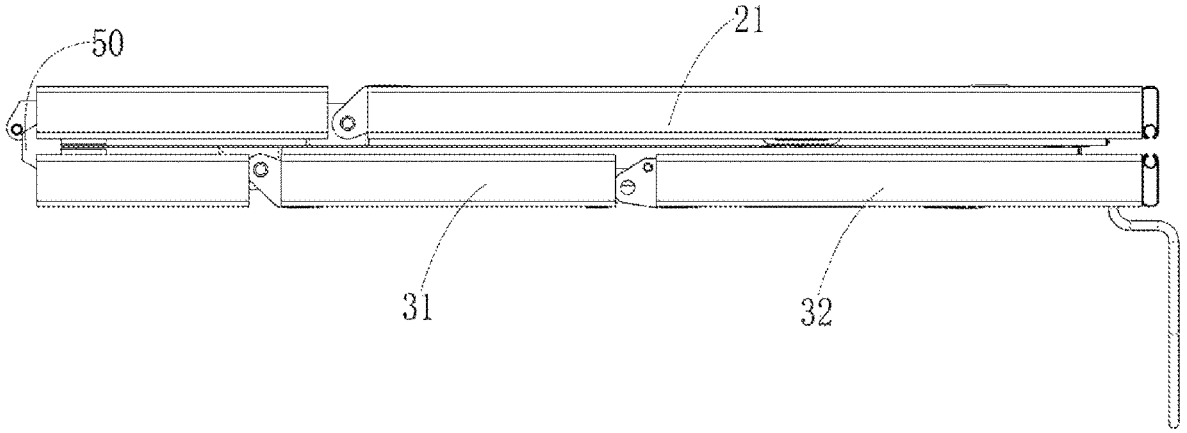
FIG. 1 is a schematic diagram of a side view of an angle-adjustable folding bed when a bed bottom frame, a back adjusting assembly and a leg adjusting assembly are folded.
Figure 2:
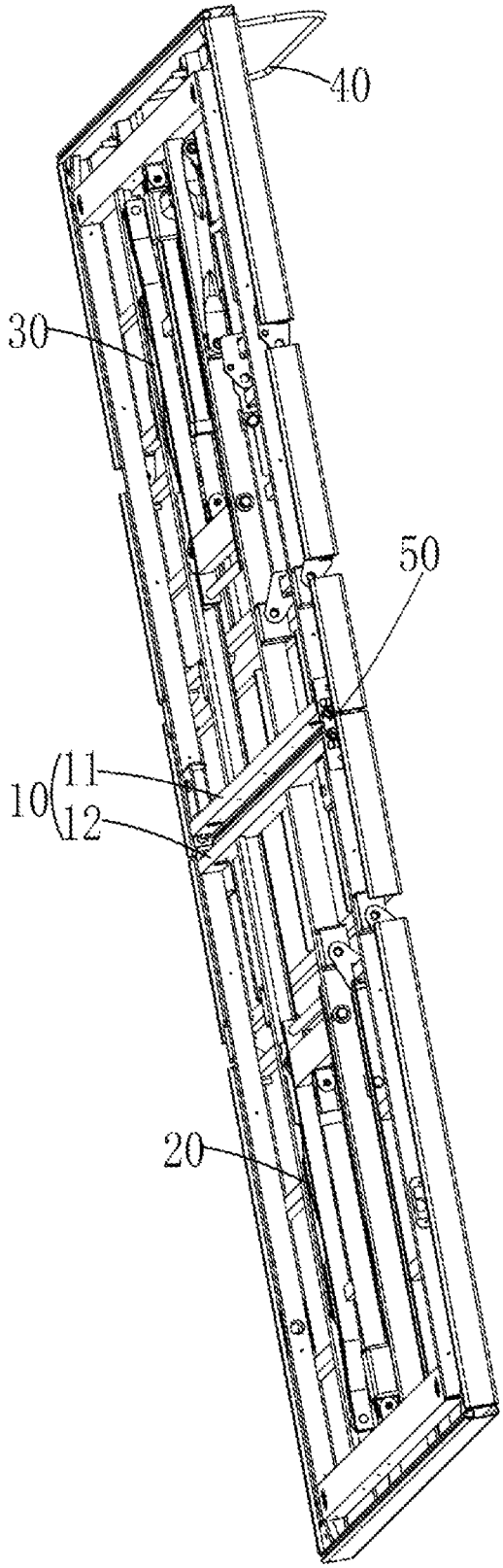
FIG. 2 is a schematic diagram of a side view of an angle-adjustable folding bed when a bed bottom frame is unfolded, a back adjusting assembly is folded and a leg adjusting assembly is folded.
Figure 3:
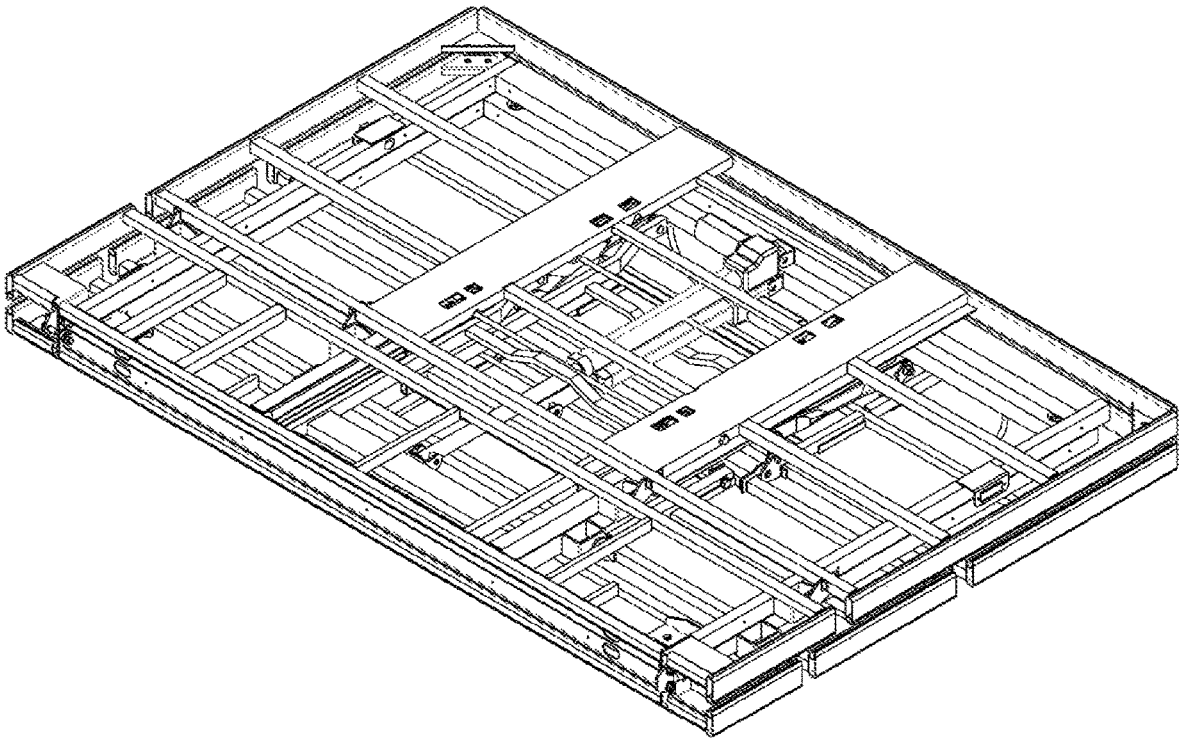
FIG. 3 is an axonometric diagram of an angle-adjustable folding bed when a bed bottom frame, a back adjusting assembly and a leg adjusting assembly all folded.
Figure 4:
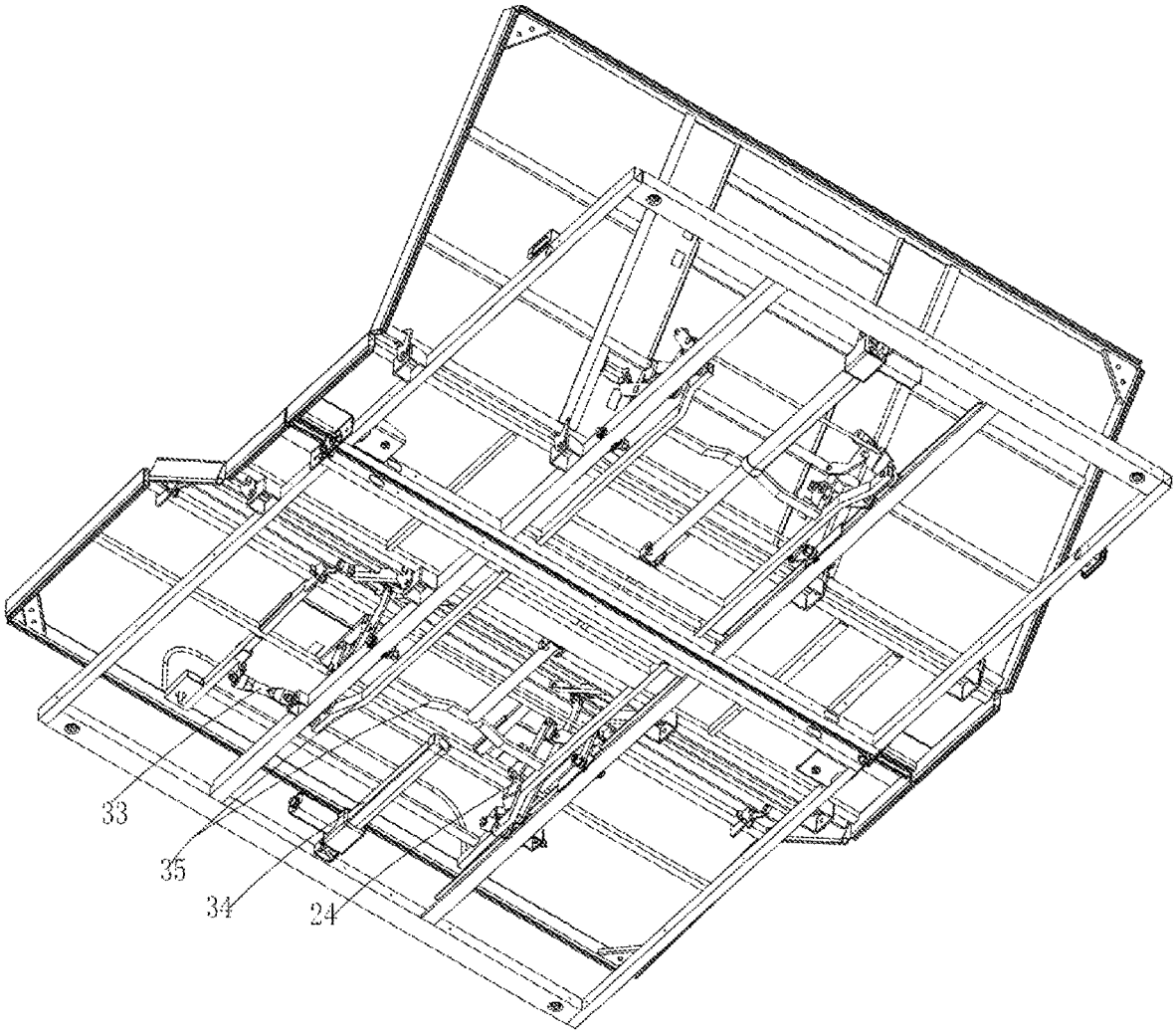
FIG. 4 is an axonometric diagram of an angle-adjustable folding bed when a bed bottom frame, a back adjusting assembly and a leg adjusting assembly are all unfolded.

The technical solutions in the embodiments of the present application are clearly and completely described below in conjunction with the accompanying drawings in the embodiments of the present application. Apparently, the embodiments described are only a part rather than all of the embodiments of the present application. All other embodiments obtained by those of ordinary skilled in the art based on the embodiments of the present application without creative efforts shall fall within the protection scope of the present application.

An objective of the present application is to provide an angle-adjustable folding bed which is convenient to store and transport while comfort is improved.

In order to make the purposes, features and advantages of the present application become more apparent and easier to understand, the present application will be further described in detail below in combination with the drawings and the specific embodiments.

In the embodiment, the unfolding state of the bed bottom frame 10 refers to the state of the bed bottom frame 10 when the front lower frame 11 and the rear lower frame 12 are coplanar, which is one of use states of the angle-adjustable folding bed. The folding state of the bed bottom frame 10 refers to the state of the bed bottom frame 10 when the front lower frame 11 and the rear lower frame 12 are stacked, which may be obtained by rotating the front lower frame 11 or the rear lower frame 12 by 180° under an unfolding state, and this state is the storage and transportation state of the angle-adjustable folding bed.

"Front" refers to the side close to the bed head when the bed bottom frame 10 is in an unfolding state, and "rear" refers to the side close to the bed tail when the bed bottom frame 10 is in an unfolding state.

The folding state of the back adjusting assembly 20 refers to the state of the back adjusting assembly 20 when the first upper frame 21 and the front lower frame 11 are stacked, under which the first upper frame 21 is parallel to or approximately parallel to the front lower frame 11. The unfolding state of the back adjusting assembly 20 refers to the state of the back adjusting assembly 20 when the front end of the first upper frame 21 is away from the front lower frame 11 for a certain distance, under which the first upper frame 21 is inclined relative to the front lower frame 11.

The folding state of the leg adjusting assembly 30 refers to the state when the second upper frame 31 and the third upper frame 32 are both stacked on the rear lower frame 12, under which the second upper frame 31 and the third upper frame 32 are both parallel to or approximately parallel to the rear lower frame 12. The unfolding state of the leg adjusting assembly 30 refers to the state of the leg adjusting assembly 30 when the second upper frame 31 is inclined relative to the rear lower frame 12 and the third upper frame 32 is away from the rear lower frame 12 for a certain distance.

Referring to FIGS. 1-6, the embodiment provides an angle-adjustable folding bed, which includes a bed bottom frame 10, the bed bottom frame 10 includes a front lower frame 11 and a rear lower frame 12, the rear end of the front lower frame 11 is rotatably connected with the front end of the rear lower frame 12. The angle-adjustable folding bed further includes a back adjusting assembly 20 disposed on the front lower frame 11 and/or a leg adjusting assembly 30 disposed on the rear lower frame 12. The angle-adjustable folding bed of the embodiment has both folding function and angle adjusting function, and thus comfort is improved while storage and transportation are facilitated.

As a preferable implementation mode, in the embodiment, the back adjusting assembly 20 includes a first upper frame 21, a front driver 22, a front sliding frame 23 and a connecting rod assembly 24. The rear end of the first upper frame 21 is rotatably connected with the front lower frame 11, after the back adjusting assembly 20 is unfolded, the first upper frame 21 is configured for leaning of the back of a user. The front driver 22 is mounted on the front lower frame 11 and is connected with the front sliding frame 23, and is configured for driving the front sliding frame 23 to slide. The front sliding frame 23 is slidably mounted on the front lower frame 11, so as to slide along the front-back direction of the front lower frame 11 under driving of the front driver 22. The front connecting rod assembly 24 is connected with the first upper frame 21 and the front sliding frame 23 respectively to drive the first upper frame 21 to swing when the front sliding frame 23 slides.

Since the front sliding frame 23 slides along the front-rear direction of the front lower frame 11, and that the front driver 22 and the front sliding frame 23 are disposed on the inner side of the front lower frame 11 refers to that they are surrounded by the front lower frame 11, thereby avoiding increase of overall thickness due to arrangement of the front driver 22 and the front sliding frame 23. The shape of the front connecting rod assembly 24 may change, so that its size is reduced accordingly when the back adjusting assembly 20 is in a folding state.

As a preferable implementation mode, in the embodiment, the front connecting rod assembly 24 includes a first connecting rod 241, a second connecting rod 242, a third connecting rod 243, a fourth connecting rod 244 and a fifth connecting rod 245. One end of the first connecting rod 241 is rotatably connected with the front sliding frame 23, a first roller 246 is mounted at the other end of the first connecting rod 241, the middle of the first connecting rod 241 is rotatably connected with one end of the second connecting rod 242, the other end of the second connecting rod 242 is rotatably connected with one end of the third connecting rod 243, the rotatably connecting position is point C in FIG. 5, the other end of the third connecting rod 243 is rotatably connected with one end of the fourth connecting rod 244, the rotatably connecting position is point A in FIG. 5, the other end of the fourth connecting rod 244 is rotatably connected with the front lower frame 11, one end of the fifth connecting rod 245 is rotatably connected with the front sliding frame 23, the other end of the fifth connecting rod 245 is rotatably connected with the first upper frame 21, the middle of the fifth connecting rod 245 is rotatably connected with the middle of the third connecting rod 243, and the rotatably connecting position is point B in FIG. 5. A limiting piece 247 is disposed on the first connecting rod 241, and a concave position which is configured for limiting abutting with the limiting piece 247 is disposed on the second connecting rod 242. By adjusting the position of the front sliding frame 23, the position and angle of the fifth connecting rod 245 may be adjusted accordingly, so as to drive the first upper frame 21 to swing. When the back adjusting assembly 20 is in a folding state, one end of the first connecting rod 241 is furthest away from the other end of the fourth connecting rod 244, an overall structure formed by the first connecting rod 241, the second connecting rod 242, the third connecting rod 243 and the fourth connecting rod 244 is approximately flattened, and the overall structure is fully or mostly located on the inner side of the front lower frame 11 to reduce the overall size. When the back adjusting assembly 20 is in an unfolding state, one end of the first connecting rod 241 is nearest to the other end of the fourth connecting rod 244, and the first connecting rod 241, the second connecting rod 242, the third connecting rod 243 and the fourth connecting rod 244 all move towards the upper side of the front lower frame 11.

Specifically, when the back adjusting assembly 20 is gradually unfolded from the folding state, it is divided into the following movement stages.

Movement stage 1: the front driver 22 pushes the front sliding frame 23 to slide backwards, and the front sliding frame 23 drives the front end of the first connecting rod 241 to slide backwards, so that the first connecting rod 241 rotates relative to the second connecting rod 242 until the limiting piece 247 on the first connecting rod 241 clamps the concave position of the second connecting rod 242. In this process, the first roller 246 mounted at the other end of the first connecting rod 241 will be in rolling contact with the first upper frame 21, causing the first upper frame 21 to rotate by a certain angle such as 10°.

Figure 5:
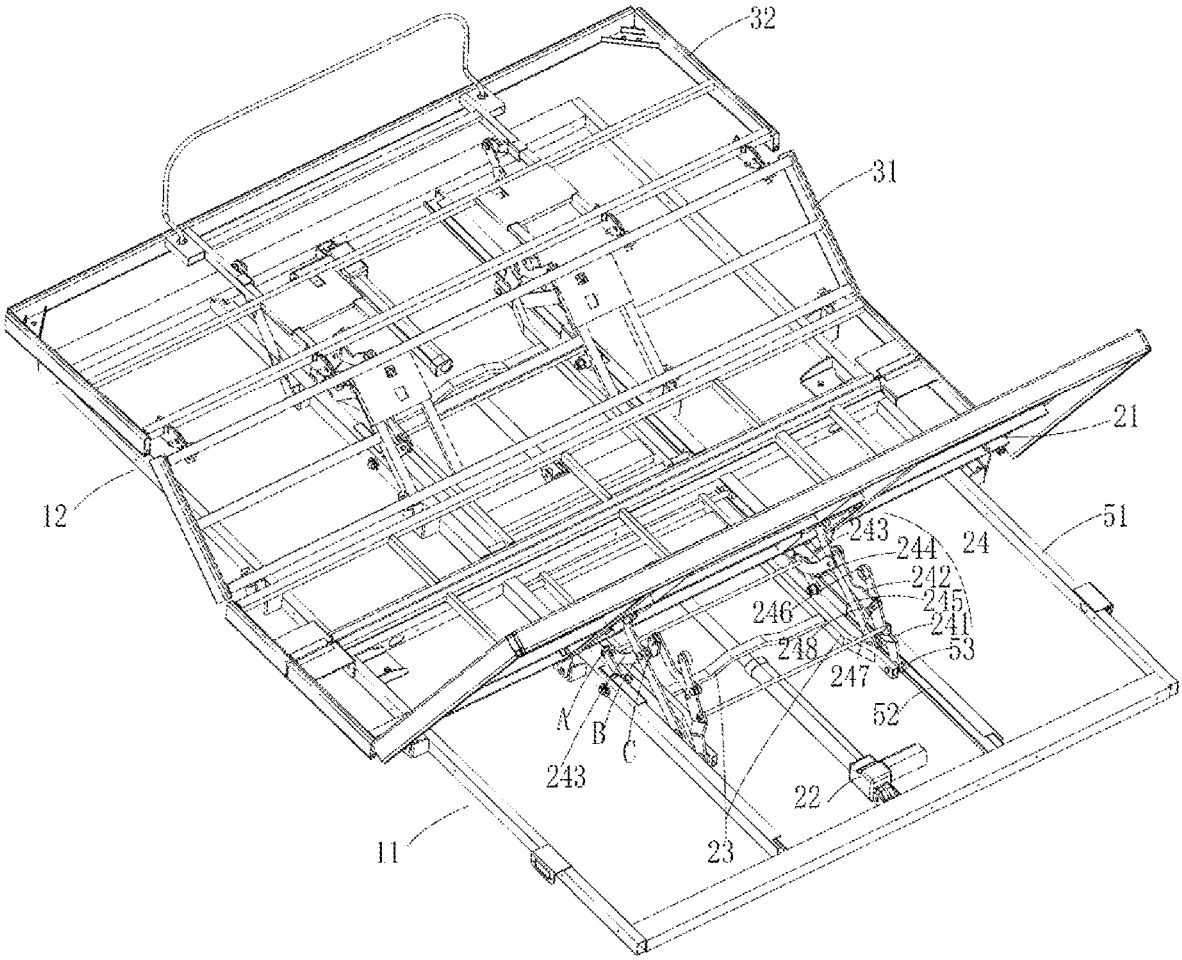
FIG. 5 is a schematic structure diagram from another perspective of FIG. 4.
Figure 6:
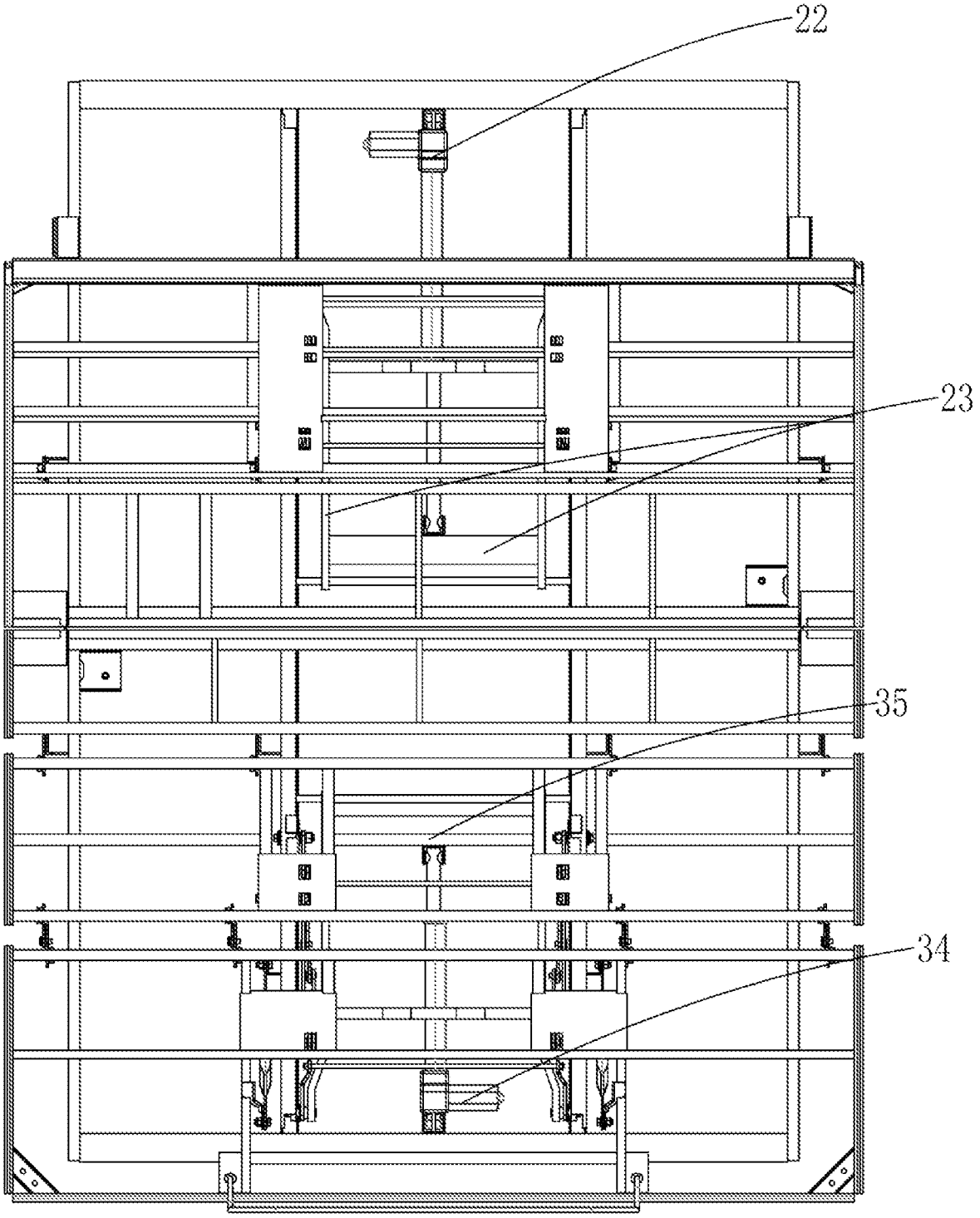
FIG. 6 is a schematic diagram of a top view of an angle-adjustable folding bed when a bed bottom frame is unfolded, a back adjusting assembly is folded and a leg adjusting assembly is folded.

Movement stage 2: after the limiting piece 247 abuts against the blocking part 248 on the second connecting rod 242, the preferable mode of the blocking part 248 is the concave position, and the second connecting rod 242 is relatively fixed with the first connecting rod 241, in such a case, the front sliding frame 23 continues to slide backwards, driving the fifth connecting rod 245 to move, then the first upper frame 21 is driven to rotate, at this stage, the first roller 246 is separated from the first upper frame 21. In FIG. 5, three rotatably connecting positions on the third connecting rod 243 are A, B and C, the first upper frame 21 downwards presses the fifth connecting rod 245, and the fifth connecting rod 245 downwards presses the third connecting rod 243, that is, the first upper frame 21 indirectly downwards presses the third connecting rod 243. Meanwhile, the first connecting rod 241 lifts the second connecting rod 242, and the second connecting rod 242 lifts the third connecting rod 243, that is, the first connecting rod 241 indirectly lifts the third connecting rod 243. With point A as the rotation center, the application point of force applied by the fifth connecting rod 245 on the third connecting rod 243 is point B, and the application point of force applied by the second connecting rod 242 on the third connecting rod 243 is point C. In FIG. 5, the moment of force applied by the fifth connecting rod 245 on the third connecting rod 243 is approximately the distance between point A and point B, and the moment of force applied by the second connecting rod 242 on the third connecting rod 243 is approximately the distance between point A and point C. Obviously, the distance between point A and point C is greater than that between point A and point B, so according to the lever theorem, the structure may save labor.

As a preferable implementation mode, the leg adjusting assembly 30 includes a second upper frame 31, a third upper frame 32, a pull rod 33, a rear driver 34, a rear sliding frame 35 and a connecting rod assembly 24. After the leg adjusting assembly 30 is unfolded, the second upper frame 31 is configured to support the thigh of the user, and the third upper frame 32 is configure to support the shank of the user. The second upper frame 31, the third upper frame 32, the pull rod 33 and the rear lower frame 12 are rotatably connected in sequence to form a quadrilateral connecting rod mechanism. The rear driver 34 is mounted on the rear lower frame 12 and is connected with the rear sliding frame 35, and is configured for driving the rear sliding frame 35 to slide. The rear sliding frame 35 is slidably mounted on the rear lower frame 12, so as to move along the front-back direction of the rear lower frame 12 under driving of the rear driver 34. The connecting rod assembly 24 is rotatably connected with the second upper frame 31, the rear sliding frame 35 and the rear lower frame 12; the connecting rod assembly 24 includes a first connecting rod 241, a second connecting rod 242, a third connecting rod 243, a fourth connecting rod 244 and a fifth connecting rod 245; one end of the first connecting rod 241 is rotatably connected with the rear sliding frame 35, the middle of the first connecting rod 241 is rotatably connected with one end of the second connecting rod 242, the other end of the second connecting rod 242 is rotatably connected with one end of the third connecting rod 243, the other end of the third connecting rod 243 is rotatably connected with one end of the fourth connecting rod 244, the other end of the fourth connecting rod 244 is rotatably connected with the front lower frame 11, one end of the fifth connecting rod 245 is slidably connected with the rear lower frame 12, the other end of the fifth connecting rod 245 is rotatably connected with the second upper frame 31, the middle of the fifth connecting rod 245 is rotatably connected with the middle of the third connecting rod 243, a limiting piece 247 is disposed on the first connecting rod 241, and a blocking part 248 which is configured for limiting abutting with the limiting piece 247 is disposed on the second connecting rod 242; the second upper frame 31 is rotatably connected with the rear lower frame 12, two ends of the pull rod 33 are rotatably connected with the third upper frame 32 and the rear lower frame 12 respectively, and the second upper frame 31, the third upper frame 32, the pull rod 33 and the rear lower frame 12 are rotatably connected to form a quadrangle; in a process that the rear sliding frame 35 moves towards a direction close to the fourth connecting rod 244, the first connecting rod 241 is driven to rotate to a state that the limiting piece 247 is in contact with the blocking part 248, and rotation of the first connecting rod 241 and the second connecting rod 242 in an original rotating direction is blocked; in a process that the rear sliding frame 35 moves towards a direction further close to the fourth connecting rod 244, the fifth connecting rod 245 drives the second upper frame 31 to incline forwards under the action of the third connecting rod 243, and the second upper frame 31 drives the third upper frame 32 which is lifted up under the action of the pull rod 33; in a process that the rear sliding frame 35 moves towards a direction away from the fourth connecting rod 244, the first connecting rod 241 rotates counterclockwise till the limiting piece 247 is separated from the blocking part 248, and in a process that the rear sliding frame 35 moves towards a direction further away from the fourth connecting rod 244, the fifth connecting rod 245 drives the second upper frame 31 to lie flat and the third upper frame 32 to move downwards under the action of the third connecting rod 243.

Since the rear sliding frame 35 slides along the front-rear direction of the rear lower frame 12, and that the rear driver 34 and the rear sliding frame 35 are disposed on the inner side of the rear lower frame 12 refers to that they are surrounded by the rear lower frame 12, thereby avoiding increase of overall thickness due to arrangement of the rear driver 34 and the rear sliding frame 35.

As a preferable implementation mode, the angle-adjustable folding bed further includes a guardrail 40, which is separately inserted on the third upper frame 32. The guardrail 40 may be limited through structures such as a limiting pin and a bolt after plugging, so as to improve stability.

As a preferable implementation mode, when the bed bottom frame 10 is in an unfolding state, the lower surfaces of the front lower frame 11 and the rear lower frame 12 are both configured for direct contact with the ground, namely, the front lower frame 11 and the rear lower frame 12 are not provided with legs to reduce the overall size. When the bed bottom frame 10, the back adjusting assembly 20 and the leg adjusting assembly 30 are all folded, the thickness of the angle-adjustable folding bed is not greater than 110 mm, referring to FIGS. 1 and 3, the thickness herein refers to the thickness when the guardrail 40 is not mounted. When the bed bottom frame 10 is unfolded, the back adjusting assembly 20 is folded and the leg adjusting assembly 30 is folded, the thickness of the angle-adjustable folding bed is not greater than 55 mm, referring to FIG. 2.

As a preferable implementation mode, the front lower frame 11 is rotatably connected with the rear lower frame 12 through an intermediate piece 50; the intermediate piece 50 is located on the side of the front lower frame 11 and the rear lower frame 12, the rear end of the front lower frame is hinged with the front end of the intermediate piece 50, and the rear end of the intermediate piece 50 is hinged with the front end of the rear lower frame 12; and the side of the first upper frame 21 extends out of the side of the bed bottom frame 10 to shield the intermediate piece 50 in the vertical direction. The front lower frame 11 is rotatably connected with the rear lower frame 12 through an intermediate piece 50; the rear end of the front lower frame is hinged with the front end of the intermediate piece 50, and the rear end of the intermediate piece 50 is hinged with the front end of the rear lower frame 12; and the sides of the second upper frame 31 and the third upper frame 32 extend out of the side of the bed bottom frame 10 to shield the intermediate piece 50 in the vertical direction. In the implementation mode, the intermediate piece 50 is of a metal integrated structure, the front and rear ends of which run stably and reliably after being hinged with the front lower frame 11 and the rear lower frame 12 respectively, and the sides of the first upper frame 21, the second upper frame 31 and the third upper frame 32 extend out of the side of the bed bottom frame 10 to shield the intermediate piece 50 in the vertical direction, therefore, in a use process, a consumer cannot touch the intermediate piece 50 disposed in a protruding manner, thereby avoiding injury to a human body due to collision.

As a preferable implementation mode, each of the front lower frame 11 and the rear lower frame 12 includes a rectangular outer frame 51, two parallel channel steels 52 are disposed in the outer frame 51, the length direction of the channel steel 52 is parallel to the length direction of the angle-adjustable folding bed, and the notches of the two channel steels 52 are disposed face to face; and the side, close to the channel steel 52, of the front sliding frame 23 is respectively provided with two pulleys 53 rotatably disposed, the pulleys 53 are located in the channel steel 52, and the front driver 22 is disposed horizontally.

As a preferable implementation mode, the fourth connecting rod 244 has the smallest distance between one end and the other end relative to the first connecting rod 241, the second connecting rod 242 and the third connecting rod 243, the third connecting rod 243 has the largest distance between one end and the other end relative to the first connecting rod 241 and the second connecting rod 242, and the length after the first connecting rod 241 and the second connecting rod 242 are rotatably connected is greater than the distance between one end and the other end of the third connecting rod 243. In the embodiment, in order to realize a smaller height under a flat lying state, after the front lower frame 11 and the rear lower frame 12 are close and folded, storage and transportation space is saved, thus meeting the requirement of adequately supporting the first upper frame 21. The length of the first connecting rod 241, the second connecting rod 242, the third connecting rod 243 and the fourth connecting rod 244 needs to be improved.

The principle and implementation mode of the present application have been described herein using specific examples, and the above description of the embodiments is only intended to help understand the method of the present application and its core idea. Meanwhile, those of ordinary skill in the art may make variations in terms of specific implementation mode and scope of application in accordance with the idea of the present application. In summary, the description of the specification should not be construed as limiting the present application.

What is claimed is:

1. An angle-adjustable folding bed, comprising a bed bottom frame, the bed bottom frame comprises a front lower frame and a rear lower frame, a rear end of the front lower frame is rotatably connected with a front end of the rear lower frame, and further comprising a back adjusting assembly disposed on the front lower frame;

wherein the back adjusting assembly comprises a first upper frame, a front driver, a front sliding frame and a connecting rod assembly; a rear end of the first upper frame is rotatably connected with the front lower frame; the front driver is mounted on the front lower frame and is connected with the front sliding frame; the front sliding frame is slidably mounted on the front lower frame, and the front driver is configured to drive the front sliding frame to linearly slide along a front-back direction of the front lower frame; the connecting rod assembly is rotatably connected with the first upper frame, the front sliding frame and the front lower frame, and the front sliding frame is configured to drive the first upper frame to incline forwards and lean backwards through the connecting rod assembly in response to forwards and backwards sliding of the front sliding frame.

2. The angle-adjustable folding bed according to claim 1, wherein the connecting rod assembly comprises a first connecting rod, a second connecting rod, a third connecting rod, a fourth connecting rod and a fifth connecting rod; one end of the first connecting rod is rotatably connected with the front sliding frame, the middle of the first connecting rod is rotatably connected with one end of the second connecting rod, an opposite end of the second connecting rod is rotatably connected with one end of the third connecting rod, an opposite end of the third connecting rod is rotatably connected with one end of the fourth connecting rod, an opposite end of the fourth connecting rod is rotatably connected with the front lower frame, one end of the fifth connecting rod is slidably connected with the front lower frame, an opposite end of the fifth connecting rod is rotatably connected with the first upper frame, the middle of the fifth connecting rod is rotatably connected with the middle of the third connecting rod, a limiting piece is disposed on the first connecting rod, and a blocking part configured to abut against the limiting piece is disposed on the second connecting rod; wherein the connecting rod assembly is arranged such that, when the front sliding frame moves towards the fourth connecting rod, the first connecting rod rotates until the limiting piece contacts with the blocking part, thereby limiting further rotation of the first connecting rod and the second connecting rod; further movement of the front sliding frame in the same direction causes the fifth connecting rod, via the third connecting rod, to incline the first upper frame forward; when the front sliding frame moves towards a direction away from the fourth connecting rod, the first connecting rod rotates counterclockwise until the limiting piece separates from the blocking part, and when the front sliding frame moves towards a direction further away from the fourth connecting rod, the fifth connecting rod is configured to drives the first upper frame to lean backwards via the third connecting rod.

3. The angle-adjustable folding bed according to claim 2, wherein the blocking part comprises a concave position into which the limiting piece is configured to fall.

4. The angle-adjustable folding bed according to claim 2, wherein when the front sliding frame moves to a position furthest away from the fourth connecting rod, the height of the connecting rod assembly is smaller than or equal to that when the front lower frame and the first upper frame are overlapped.

5. The angle-adjustable folding bed according to claim 2, wherein a first roller is mounted at an opposite end of the first connecting rod.

6. The angle-adjustable folding bed according to claim 2, wherein the fourth connecting rod has the smallest distance between one end and an opposite end relative to the first connecting rod, the second connecting rod and the third connecting rod, the third connecting rod has the largest distance between one end and an opposite end relative to the first connecting rod and the second connecting rod, and a sum of length of the first connecting rod and the second connecting rod rotatably connected is greater than a distance between one end and an opposite end of the third connecting rod.

7. The angle-adjustable folding bed according to claim 1, further comprising a leg adjusting assembly disposed on the rear lower frame; wherein the leg adjusting assembly comprises a second upper frame, a third upper frame rotatably connected with the second upper frame, a pull rod, a rear driver, a rear sliding frame and a connecting rod assembly; the rear driver is mounted on the rear lower frame and connected with the rear sliding frame; the rear sliding frame is slidably mounted on the rear lower frame, and the rear driver is configured to drives the rear sliding frame to move linearly along a front-back direction of the rear lower frame; the connecting rod assembly is rotatably connected with the second upper frame, the rear sliding frame and the rear lower frame; the connecting rod assembly comprises a first connecting rod, a second connecting rod, a third connecting rod, a fourth connecting rod and a fifth connecting rod; one end of the first connecting rod is rotatably connected with the rear sliding frame, the middle of the first connecting rod is rotatably connected with one end of the second connecting rod, an opposite end of the second connecting rod is rotatably connected with one end of the third connecting rod, an opposite end of the third connecting rod is rotatably connected with one end of the fourth connecting rod, an opposite end of the fourth connecting rod is rotatably connected with the front lower frame, one end of the fifth connecting rod is slidably connected with the rear lower frame, an opposite end of the fifth connecting rod is rotatably connected with the second upper frame, the middle of the fifth connecting rod is rotatably connected with the middle of the third connecting rod, a limiting piece is disposed on the first connecting rod, and a blocking part which is configured for limiting abutting with the limiting piece is disposed on the second connecting rod; the second upper frame is rotatably connected with the rear lower frame, two ends of the pull rod are rotatably connected with the third upper frame and the rear lower frame respectively, and the second upper frame, the third upper frame, the pull rod and the rear lower frame are rotatably connected to form a quadrangle; wherein the connecting rod assembly is configured such that movement of the rear sliding frame toward the fourth connecting rod causes the first connecting rod to rotate until the limiting piece contacts the blocking part, thereby restricting rotation of the first connecting rod and the second connecting rod; further movement of the rear sliding frame in the same direction causes the fifth connecting rod, via the third connecting rod, to incline the second upper frame forward, thereby lifting the third upper frame via the pull rod; movement of the rear sliding frame in a direction away from the fourth connecting rod causes the first connecting rod to rotates counterclockwise until the limiting piece is separated from the blocking part, and continued movement of the rear sliding frame causes the fifth connecting rod to bring the second upper frame to lie flat and move the third upper frame downwards via the third connecting rod.

8. The angle-adjustable folding bed according to claim 7, wherein when the rear sliding frame moves to a position furthest away from the fourth connecting rod, the height of the connecting rod assembly is smaller than or equal to that when the rear lower frame and the second upper frame are overlapped.

9. The angle-adjustable folding bed according to claim 7, further comprising a guardrail, which is detachably mounted on the third upper frame.

10. The angle-adjustable folding bed according to claim 7, wherein the front lower frame is rotatably connected with the rear lower frame through an intermediate piece; the rear end of the front lower frame is hinged with a front end of the intermediate piece, and a rear end of the intermediate piece is hinged with the front end of the rear lower frame; and one side portion of the second upper frame and one side portion of the third upper frame extend out of a side of the bed bottom frame to cover the intermediate piece in a vertical direction.

11. The angle-adjustable folding bed according to claim 1, wherein lower surfaces of the front lower frame and the rear lower frame are both configured for direct contact with the ground; when the bed bottom frame, the back adjusting assembly and the leg adjusting assembly are folded, the thickness of the angle-adjustable folding bed is not greater than 110 mm; when the bed bottom frame is unfolded, the back adjusting assembly is folded, and the leg adjusting assembly is folded, the thickness of the angle-adjustable folding bed is not greater than 55 mm.

12. The angle-adjustable folding bed according to claim 1, wherein the front lower frame is rotatably connected with the rear lower frame through an intermediate piece; the intermediate piece is located on one side of the front lower frame and one side of the rear lower frame, the rear end of the front lower frame is hinged with a front end of the intermediate piece, and a rear end of the intermediate piece is hinged with the front end of the rear lower frame; and one side portion of the first upper frame extends out of a side of the bed bottom frame to cover the intermediate piece in a vertical direction.

13. The angle-adjustable folding bed according to claim 1, wherein each of the front lower frame and the rear lower frame comprises a rectangular outer frame, two parallel channel steels are disposed in the outer frame, a length direction of the two parallel channel steels is parallel to the length direction of the angle-adjustable folding bed, and the notches of the two parallel channel steels are disposed face to face; and a side, facing the two parallel channel steels, of the front sliding frame is respectively provided with two pulleys rotatably disposed, the pulleys are located in the two parallel channel steels, and the front driver is disposed horizontally.

* * * * *